US005557872A

United States Patent [19]

Langner

[11] Patent Number: 5,557,872

[45] Date of Patent: Sep. 24, 1996

[54] POWER SUPPLY FOR FIREARM ACCESSORIES

[76] Inventor: F. Richard Langner, 9856 E. Aster Dr., Scottsdale, Ariz. 85260

[21] Appl. No.: 450,864

[22] Filed: May 25, 1995

[51] Int. Cl.[6] ..... F41G 1/35

[52] U.S. Cl. ..... 42/103; 42/7; 42/50; 362/114

[58] Field of Search ..... 42/103, 50, 7; 362/110, 113, 114; 89/34

[56] References Cited

U.S. PATENT DOCUMENTS

| | | | |
|---|---|---|---|
| 4,936,037 | 6/1990 | Holcomb et al. | 42/106 |
| 5,052,138 | 10/1991 | Crain | 42/1.02 |
| 5,177,309 | 1/1993 | Willoughby et al. | 42/103 |
| 5,179,235 | 1/1993 | Toole | 42/103 |

FOREIGN PATENT DOCUMENTS

| | | | |
|---|---|---|---|
| 165618 | 3/1950 | Austria | 362/114 |
| 5029 | 1/1913 | United Kingdom | 362/114 |

*Primary Examiner*—Stephen M. Johnson
*Attorney, Agent, or Firm*—LaValle D. Ptak

[57] ABSTRACT

A firearm employing a cartridge magazine includes a laser sighting device or other electrical accessories attached to the firearm. A power supply is located in a housing in the lower end of the cartridge magazine. The housing has a hollow battery compartment in it with a pair of battery contacts in it. One contact is electrically connected with the cartridge magazine. The other contact is a spring-loaded contact coupled with a conductive lead to the laser sighting device or accessory. An on/off switch, preferably in the form of a push-button switch, is engaged by the user when the firearm is in use.

18 Claims, 1 Drawing Sheet

POWER SUPPLY FOR FIREARM ACCESSORIES

BACKGROUND

Modern firearms increasingly are being provided with battery powered accessories, such as laser sighting devices, for use in target acquisition. If a laser sighting device is attached to the firearm, it is necessary to provide a power supply, typically in the form of a battery, for operating the laser in the sighting device. Generally, the laser sight and the battery are located in a common housing, which then is attached to the barrel of the firearm.

When a laser sighting device is used with a relatively small, lightweight firearm, such as a handgun, the laser sighting device, to be most effective, needs to be located as near as possible adjacent the end of the barrel, in front of the trigger guard. This location ensures that the spot of light projected by the laser sighting device is located as close as possible to the trajectory of a bullet emerging from the barrel when the gun is fired. This permits rapid and accurate sighting of the handgun, without requiring the use of optical sights by the user of the handgun. In addition, this location ensures that the laser will provide accurate placement of shots over a longer range than for a laser located away from the barrel.

It also is necessary to provide an "on/off" switch for operating the laser sighting device at times only when the firearm is directed toward a target and is ready to fire. If a simple on/off switch is provided in a separate location on the housing for the laser, the user of the firearm may forget to turn the laser off after use of the firearm has been completed, thereby discharging the battery. In addition, if the firearm is being operated under emergency conditions, the extra step necessary to turn on the laser sighting device may be forgotten, or there may not be sufficient time to energize the laser. If the necessity of employing separate or additional steps to activate or turn on the laser results in too much delay, the effectiveness of the laser sighting device may be lost when it inadvertently is not turned on, or if the operator of the firearm neglects to turn on the laser sighting device.

Most handguns and many rifles employ a cartridge magazine for holding several cartridges and feeding those cartridges to the firing chamber of the handgun or rifle in an automatic or semi-automatic manner. When used with handguns, the conventional cartridge magazines fit into the frame of the handgrip of the handgun, located behind the trigger. For rifles, the magazine typically is located in a separate magazine ahead of the trigger.

Accordingly, it is an object of this invention to provide an power supply for a laser sighting device, or other accessory on a firearm, which is located in the bottom of the cartridge magazine separate from the laser sighting device itself, and which has an on/off switch location automatically engaged by the hand of the user when the firearm is in use.

SUMMARY OF THE INVENTION

It is an object of this invention to provide an improved power supply for accessories carried by a firearm.

It is another object of this invention to provide a power supply for a laser sighting device for a firearm where the power supply is located in a cartridge magazine for the firearm.

It is an additional object of this invention to provide an improved power supply for accessories carried by a firearm where the power supply is located in the handgrip frame of the firearm.

It is a further object of this invention to provide an improved power supply for accessories carried on a firearm with the power supply located in the handgrip of the firearm and actuated by a switch located on the handgrip.

In a preferred embodiment of the invention, a power supply is designed for providing power to accessories carried by a firearm of the type having a hollow handgrip frame, with a cartridge magazine insertable into the frame. A housing is located within the lower end of the cartridge magazine; and this housing has a hollow battery compartment in it. Contact members are located in the battery compartment for mating with corresponding contacts on a battery placed in the battery compartment. An electrical connection then is made between the first contact member and the cartridge magazine, which, in turn, is in electrical contact with the remainder of the firearm. A second electrical connector then passes through the housing in the cartridge magazine and is insulated from the cartridge magazine to connect with the second contact member in the battery compartment. When the cartridge magazine is inserted into the firearm, electrical power for providing power to the accessories carried by the firearm is supplied between the second electrical connector and the body of the firearm itself.

DETAILED DESCRIPTION

Figure 1:
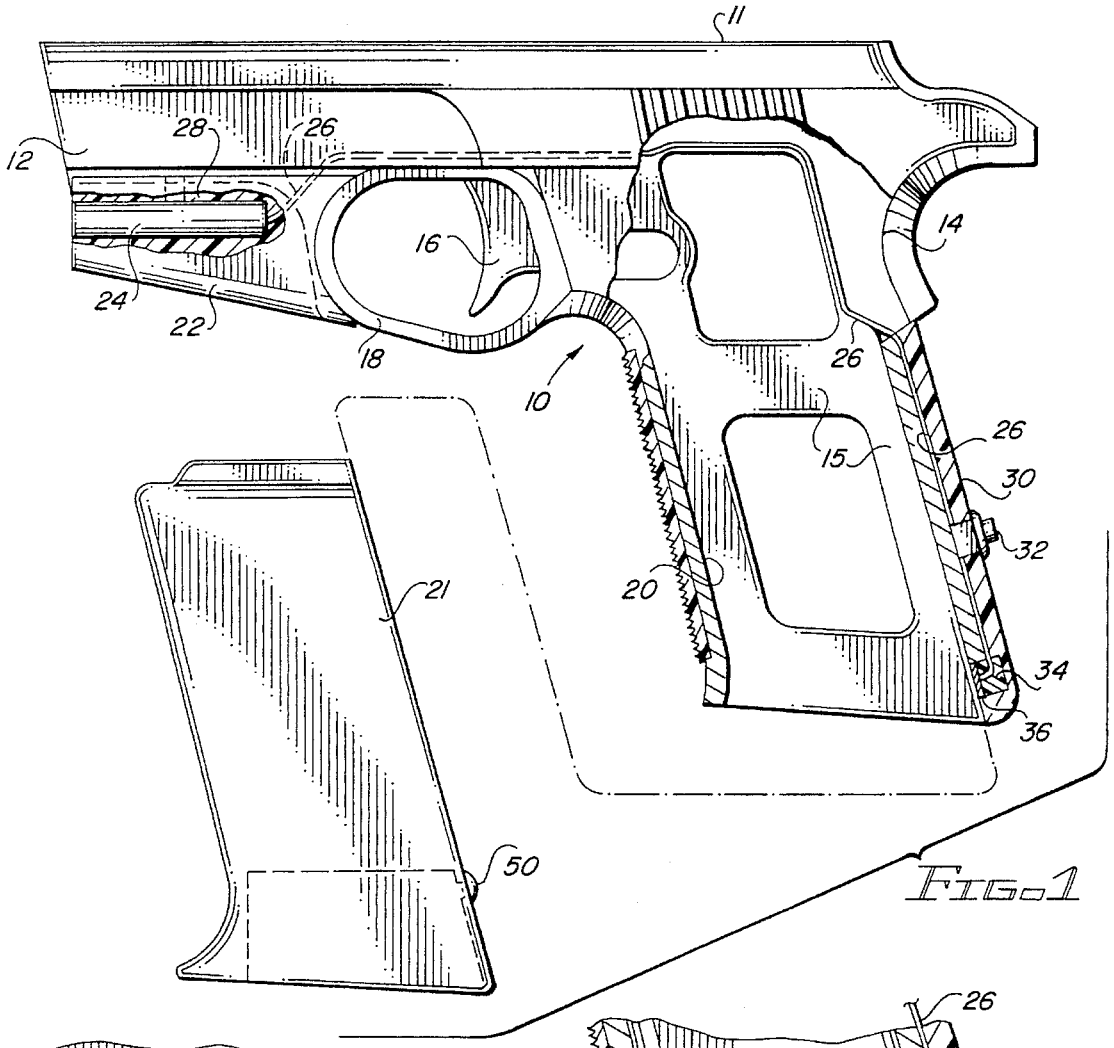
FIG. 1 is a partially cut-away, exploded, side view of a preferred embodiment of the invention.

Reference now should be made to the drawing, in which the same reference numbers are used throughout the different figures to designate the same components. FIG. 1 is a side view, in partial cross section, of a preferred embodiment of the invention.

As illustrated in FIG. 1, a firearm in the form of a handgun or pistol 10 has a slide 11 (containing a barrel) designed to reciprocate in a metal frame 12. The pistol includes a handgrip, consisting of an internal metal frame 15 with an upper curved portion 14 to fit over the hand of the user between the thumb and index finger. A trigger 16 is located within a trigger guard 18. The pistol 10 illustrated in FIG. 1 is a semi-automatic pistol, which is supplied with cartridges loaded into a cartridge magazine 21. The magazine 21 is removably inserted into an opening in the bottom of the metal frame 15. The magazine 21 typically is made of metal and holds a number of cartridges to permit repeated firings of the pistol 10, with the cartridges automatically being supplied to the firing chamber from the magazine 21 in a conventional manner.

The portions of the semi-automatic pistol 10 which have been described thus far are standard. This pistol, however, as illustrated in FIG. 1, is modified in accordance with a preferred embodiment of the invention to provide a laser sighting device mounted in a housing 22 attached to the frame 12 of the pistol 10 in front of the trigger guard 18, as illustrated. The housing 22 includes a battery powered laser 24, which projects a small collimated circle of light (typically, red) onto a target when the pistol 10 is pointed at the target and the battery power is supplied to the laser. The orientation of the laser 24, with respect to the barrel 11, is either parallel to the barrel 11 or tilted at a slight upward angle; so that the spot of the laser light on the target aligns with the entry point of a bullet fired from the barrel 11 at some predetermined range, such as 25 feet, or the like. In most cases, however, the laser 24 is mounted to project the collimated spot of light parallel to the barrel 11. Because of the location of the laser 24 in close proximity to the frame 12 of the pistol, the distance between the barrel 11 and the projected spot is quite small, typically on the order of 1 inch to 1½ inches.

Power for the laser 24 is obtained from a power supply which is located in a housing at the bottom end of the magazine cartridge 21. One power input terminal of the electrical connection to the laser is applied through a metal connection 24 directly through the mount to the metal frame 12 of the pistol, as illustrated in FIG. 1. The other power input terminal for the laser 24 is connected to an insulated wire or conductor 26, which is guided in a groove in the frame 12, and then downwardly along the metal frame 15 on the rear side through a push-button switch 32 to terminate at a metal contact disc 36, which is mounted in a hole in the frame 15 and insulated from the frame 15 by an insulator spacer 34 (shown in greater detail in FIG. 2).

In the final assembly of the handgun illustrated in FIG. 1, a plastic or rubber handgrip 30 typically is mounted around the handgrip frame 15 to cover the frame 15 on the sides and rear, and in many cases, on the front of the handgrip frame 15. The grip 30 provides an electrical insulation from the metal frame 15 of the handgrip and further serves to hold the conductor 26 and switch 32 in place. When the metal magazine 21 is inserted in a conventional manner into the opening in the frame 15 of the handgrip of the pistol 10, a spring-loaded conductive metal button 50 engages the contact disc 36, as illustrated in FIG. 2, to make an electrical contact between the button 50 and the contact disc 36.

Figure 2:
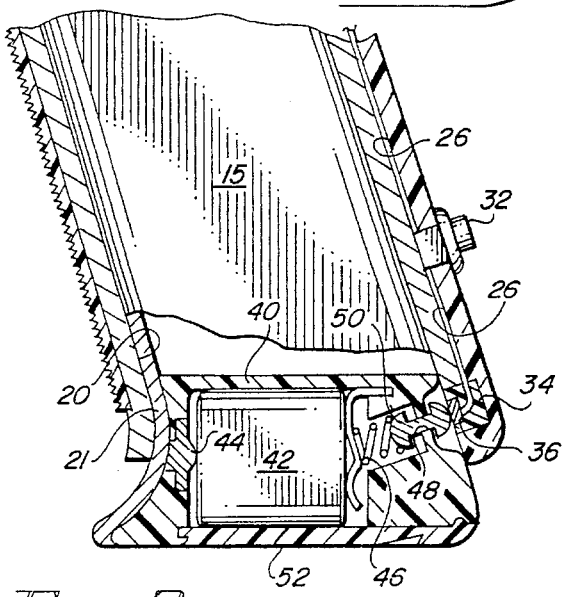
FIG. 2 is a cross-sectional view of a portion of the embodiment shown in FIG. 1.

As illustrated in FIG. 2, the bottom portion of the magazine 21 has a plastic housing 40 located in it and attached to it in any suitable manner. The housing 40 includes a hollow battery compartment, which is shaped to hold a battery 42 for powering the laser 24 shown in FIG. 1. One terminal of the battery 42, located in the hollow housing 40, is connected though a metal button 44 to the metal wall of the magazine 21. The magazine 21, in turn, is in electrical contact with the frame 15 of the pistol 10. The other battery terminal is connected through a conductive spring 46 to press the movable contact button 50 toward an extended position, as shown in FIG. 1; so that when the magazine 21 is inserted into the handgrip frame 15 of the pistol 10, the button makes electrical contact with the contact disc 36 extending through the handgun frame. It also should be noted that the button 50 is extended through an opening 48 in the housing 40, and is captivated in the housing 40; so that it remains in the extended position shown in FIG. 1 until the magazine 21 is inserted into the handgrip frame 15 of the pistol 10.

When the pistol is gripped by a user prior to firing, the closure of the hand around the handgrip 30 presses the push-button switch 32 downwardly to complete an electrical connection through the conductor 26 and the push-button switch 32 to the battery 42 in the compartment 40. This causes the power supply to the laser 24 to be completed; and the laser 24 then projects the collimated circle of light necessary for sighting in the pistol prior to firing it. When hand grip pressure is reduced and when the pistol is returned to its storage position, the pressure on the push-button switch 32 is released; and the switch automatically opens to disconnect the power to the laser 24. As illustrated in FIG. 2, a slide-out battery access panel 52 of conventional design is provided to permit replacement or changing of the battery 42 whenever necessary.

Figure 3:
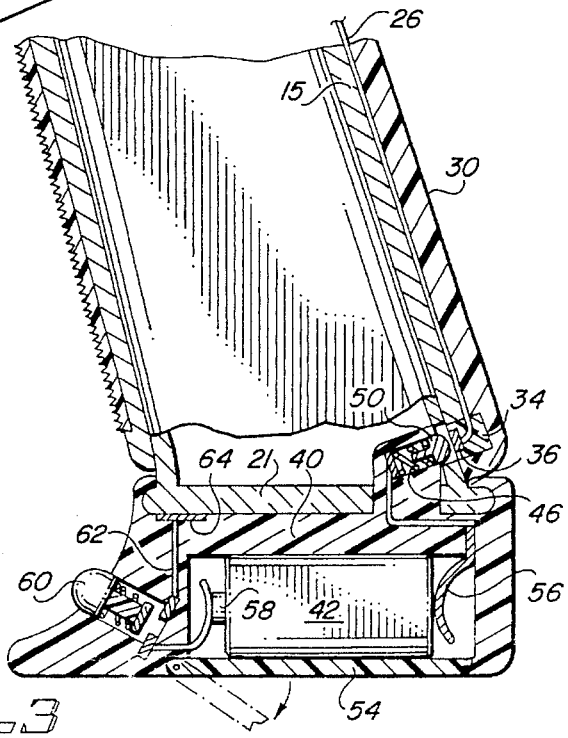
FIG. 3 is a cross-sectional view of an alternative to the embodiment shown in FIG. 2.

FIG. 3 illustrates an alternative embodiment of the invention illustrated in FIG. 2. In the embodiment of FIG. 3, the insulated housing 40 also functions as a magazine grip extension at the bottom of the handgrip of the pistol frame. Such magazine extensions are utilized to provide a longer handgrip on smaller pistols. The operation of the embodiment shown in FIG. 3 is the same as that described above in conjunction with FIG. 2. The location of the switch 32, however, has been changed from the back of the handgrip, as illustrated in FIGS. 1 and 2, to the bottom of the front housing extension. The switch is a similar push-button switch 60, which is located in series circuit between a spring contact 58, which presses against one end of the battery 42 and a lead 62 connected to a plate 64, soldered to or otherwise electrically attached to the metal frame of the magazine 21. At the other end, the battery contact is made through a spring 56 to one end of the coil spring 46, which engages the push button metal contact 50 in the same manner described in conjunction with FIG. 2.

When the magazine of FIG. 3 is inserted into the handgrip frame 15 of the pistol 10, the spring-loaded contact 50 engages the contact disc 36 to complete electrical contact to the battery 42. When the small finger of the hand of the user of the handgun wraps around the forward side of the grip extension formed by the housing 40, the switch 60 is depressed to complete electrical contact, through the battery and through the path described previously to the laser 24. In the embodiment shown in FIG. 3, the opening to the battery compartment is shown as being provided by a hinged door 54, which also is of conventional construction, to permit access to the battery 44 for insertion and replacement as needed.

Although the invention which has been described above is illustrated in conjunction with a handgun, the location of the power supply in the bottom of a cartridge magazine also equally is applicable to rifles and other semi-automatic or automatic weapons employing magazine cartridges. The principles of operation are the same, whether the firearm is a pistol 10, such as shown in FIG. 1, or is a rifle or other type of firearm employing a cartridge magazine. It should be noted that only one wire needs to be provided from the laser 24 in the housing 22 to connect with the battery 42 in the insulated housing 40 at the bottom of the cartridge magazine 21, since the other terminal for completing the electrical circuit to the laser 24 is completed through the metal frame of the gun and the metal frame 21 of the cartridge magazine. The polarity of the connections to the laser 24 may include a positive connection through the frame 12 of the firearm, through the connector 28 to the laser 24, with the negative connection being supplied through the conductor 26, or vice-versa. The power supply operation is the same in either case.

The foregoing description of the preferred embodiment of the invention is to be considered as illustrative and not as limiting. Various changes will occur to those skilled in the art for performing substantially the same function, in substantially the same way, to achieve substantially the same result, without departing from the true scope of the invention as defined in the appended claims.

What is claimed is:

1. A power supply for providing power to accessories carried by a firearm having a barrel and a hollow handgrip frame with a cartridge magazine having upper and lower ends, the upper end of said magazine being designed for insertion into said hollow handgrip frame, said power supply including in combination:

a housing located within the lower end of said cartridge magazine and having a hollow battery compartment therein for receiving a battery;

first and second contact members in said housing compartment for mating corresponding contacts on said battery placed in said battery compartment;

an electrical connection between said first contact member and said cartridge magazine;

an electrical connector through said housing, and insulated from said cartridge magazine, to said second contact member; and an electrical conductor carried by said handgrip frame and terminating in a handgrip contact and wherein said electrical connector is spring-loaded for extending a predetermined distance out of said housing for contacting said handgrip contact with said cartridge magazine inserted into said hollow handgrip frame.

2. The combination according to claim 1 wherein said handgrip frame and said cartridge magazine are made of electrically conductive material, with said cartridge magazine being in electrical contact with said handgrip frame when said cartridge magazine is inserted into said handgrip frame.

3. The combination according to claim 2 wherein said electrically powered accessory is a laser sighting device with first and second power supply terminals, said first power supply terminal in electrical contact with said handgrip frame and said second power supply terminal coupled with said electrical conductor.

4. The combination according to claim 3 further including an on/off switch connected in series circuit with at least one of said electrical connection and said electrical conductor for controlling the application of power from said battery in said hollow battery compartment to said electrical accessory.

5. The combination according to claim 4 wherein said switch is a pressure activated switch.

6. The combination according to claim 5 wherein said switch is located for engagement by a person grasping the handgrip of said firearm in a firing position.

7. The combination according to claim 1 further including an on/off switch connected in series circuit with at least one of said electrical connection and said electrical conductor for controlling the application of power from said battery in said hollow battery compartment to said electrical accessory.

8. The combination according to claim 7 wherein said switch is a pressure activated switch.

9. The combination according to claim 8 wherein said switch is located for engagement by a person grasping the handgrip of said firearm in a firing position.

10. The combination according to claim 1 wherein said electrically powered accessory is a laser sighting device with first and second power supply terminals, said first power supply terminal in electrical contact with said handgrip frame and said second power supply terminal coupled with said electrical conductor.

11. The combination according to claim 10 further including an on/off switch connected in series circuit with at least one of said electrical connection and said electrical conductor for controlling the application of power from said battery in said hollow battery compartment to said electrical accessory.

12. The combination according to claim 11 wherein said switch is located for engagement by a person grasping the handgrip of said firearm in a firing position.

13. A power supply system for a laser sighting device in a handgun having a barrel and an electrically conductive hollow handgrip frame, with upper and lower ends, for receiving an electrically conductive cartridge magazine having upper and lower ends, the upper end thereof designed for insertion into said handgrip frame with said laser sighting device mounted adjacent the barrel of said handgun, said power supply system including in combination:

said laser sighting device including first and second electrical terminals thereon, with the first terminal thereof electrically connected with said handgrip frame and the second terminal thereof electrically connected with an insulated conductor terminating in a contact at the lower end of said handgrip frame and insulated therefrom;

a housing made of electrically insulating material located within the lower end of said cartridge magazine and having a hollow battery compartment therein for receiving a battery;

first and second contact members in said housing for mating with corresponding contacts on said battery placed in said compartment;

a first electrical connector between said first contact member in said housing and said cartridge magazine;

a second electrical connector extended through said housing and connected to said second contact member, said second electrical connector located for contacting said contact at the lower end of said handgrip frame.

14. The combination according to claim 13 further including an on/off switch located in series circuit with one of said first and second electrical connectors for selectively completing connection therethrough to said corresponding first and second contact members.

15. The combination according to claim 14 wherein said on/off switch is a pressure activated switch located for engagement by the hand of a person using said handgun.

16. The combination according to claim 15 wherein said second electrical connector is a spring-loaded connector including a movable contact extending a predetermined distance outside said housing for engagement with said contact at the lower end of said handgrip frame when said cartridge magazine is inserted into said hollow handgrip frame.

17. The combination according to claim 13 further including an on/off switch in series circuit with said insulated conductor.

18. The combination according to claim 13 wherein said second electrical connector is a spring-loaded connector including a movable contact extending a predetermined distance outside said housing for engagement with said contact at the lower end of said handgrip frame when said cartridge magazine is inserted into said hollow handgrip frame.

* * * * *